United States Patent [19]

Burger et al.

[11] 4,229,958

[45] Oct. 28, 1980

[54] CONTROL DEVICE PARTICULARLY FOR USE IN A LOCK

[75] Inventors: Alfred Burger; Adalbert Paar, both of Vienna, Austria

[73] Assignee: EVVA-Werk Spezialerzeugung von Zylinder- und Sicherheitsschlössern GmbH & Co., Vienna, Austria

[21] Appl. No.: 16,892

[22] Filed: Mar. 2, 1979

[30] Foreign Application Priority Data

Mar. 6, 1978 [AT] Austria ..... 1574/78
Mar. 15, 1978 [AT] Austria ..... 1839/78

[51] Int. Cl.[3] ..... E05B 28/00; E05B 47/00
[52] U.S. Cl. ..... 70/366; 70/276
[58] Field of Search ..... 70/276, 365, 366, 379 R, 70/380, 389, DIG. 60, 358

[56] References Cited

U.S. PATENT DOCUMENTS 3,418,833 12/1968 Kerr ..... 70/389
4,084,416 4/1978 Prunbauer ..... 70/276

FOREIGN PATENT DOCUMENTS 2743274 5/1978 Fed. Rep. of Germany ..... 70/366

*Primary Examiner*—Robert L. Wolfe
*Attorney, Agent, or Firm*—Michael J. Striker

[57] ABSTRACT

A control device for a magnetic cylindrical lock includes a tubular housing eventually having on its inner surface axial and circumferential grooves, a cylindrical plug rotatable in the housing about a central axis and defining a central key channel and at least one axial recess on its cylindrical surface, a plurality of magnetic rotors supported in the plug for rotation about an axis transverse to the center axis of the plug, one face of the magnetic rotors having a third recess alignable with the second recess, a sleeve arranged for rotation and for an axial displacement between the housing and the plug, and arresting elements projecting from the sleeve to cooperate with the recesses in the housing, in the plug, and in the magnetic rotary members.

12 Claims, 16 Drawing Figures

CONTROL DEVICE PARTICULARLY FOR USE IN A LOCK

BACKGROUND OF THE INVENTION

This invention relates generally to control devices for a lock and, more particularly, it relates to a control device of the type which has a housing, a cylindrical plug (i.e. core) rotatable about its center axis in the housing and supporting at least one magnetic rotor rotatable about an axis transverse to the central axis.

Control devices of this type has been described in German publications Nos. 1,553,364 and 2,330,014.

SUMMARY OF THE INVENTION

A general object of this invention is to improve such prior-art devices.

More particularly, it is an object of the invention to provide such a control device which enables both the clockwise rotation and alternatively a counterclockwise rotation of the key in the lock.

Still another object of the present invention is to provide such an improved control device which is protected against damage by excessive forces applied against the key.

In keeping with these objects, and others which will become apparent hereafter, one feature of the invention resides, in a control device of the aforedescribed type, in the provision of a sleeve arranged for rotation and for axial displacement between the housing and the cylindrical plug, and arresting elements arranged in the sleeve or housing to engage with recesses provided in the housing, in the plug and in the rotary magnetic members so as to permit or alternatively block the rotary movement of the plug.

According to another feature of this invention the sleeve has recessed run-up surfaces sloping in axial direction to cooperate with corresponding run-up surfaces of an extension of a stop ring, the latter ring being rotatably supported in the housing opposite the end face of the sleeve, and held in a fixed position relative to the housing by a spring-biased ball. Preferably, the sloping run-up surfaces of the stop ring are formed on flanges of the axial extension. In a rest position of the lock the flanges slide on corresponding recessed surfaces in the sleeve and during rotation of the plug they axially displace the sleeve and disengage the latter from the ring.

According to still another feature of this invention, the arresting elements on the sleeve have the form of arresting pins or bolts projecting inwardly into blocking recesses or longitudinal grooves in the upper surface of the plug and during the axial displacement of the sleeve engage with grooves or recesses in the magnetic rotors so that according to the angular position of the magnetic rotors they either permit or block the axial displacement of the sleeve and of the plug. Preferably, the arresting elements cooperate with recesses in the plug as well as with the longitudinal and circumferential grooves provided in the inner wall of the housing whereby the circumferential grooves communicate with the axial grooves at a point coinciding with an axial position of the sleeve in which the arresting elements give way to the rotation of the sleeve together with the plug. The outer and inner sections of the arresting elements can be arranged flush with each other.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
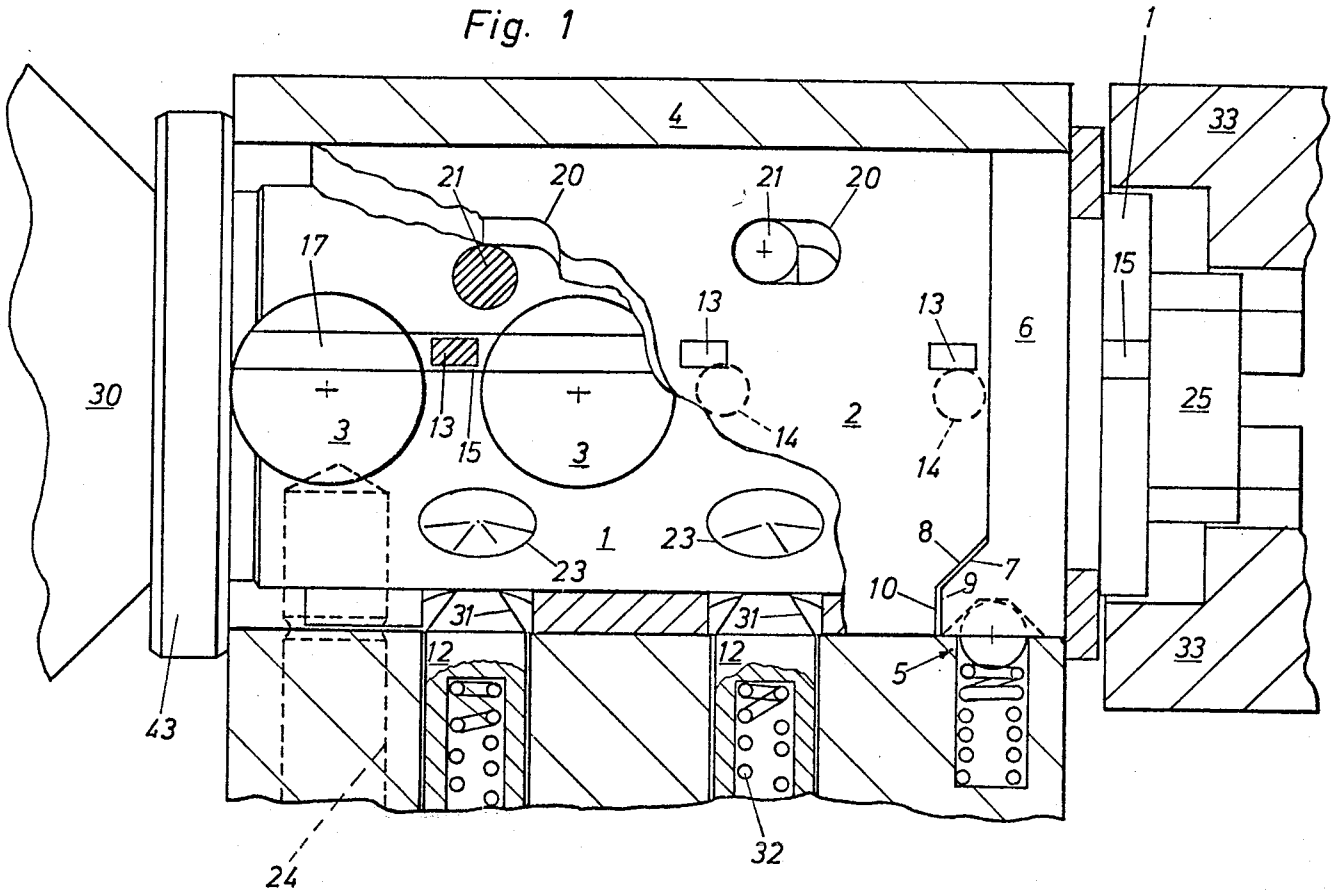
FIG. 1 is a sectional and partly cut-away side view of the left half of a double cylinder lock.
Figure 9:
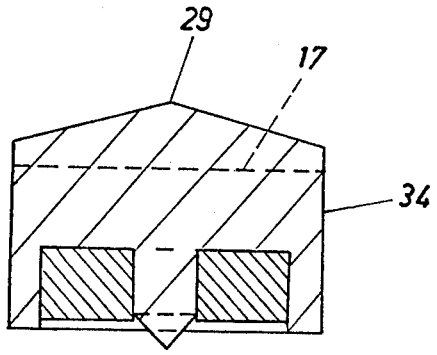
FIG. 9 is a sectional side view of a magnetic rotor.
Figure 10:
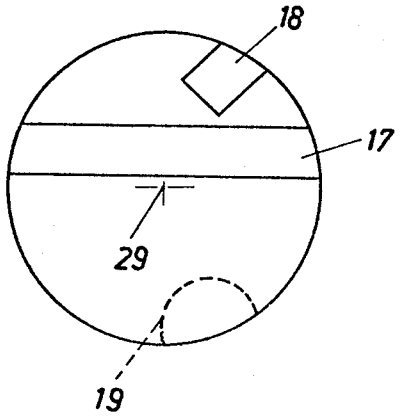
FIG. 10 is a top view of a magnetic rotor of FIG. 9.

The control device according to this invention as illustrated in the embodiment shown in FIGS. 1–13 has a housing 4 in which a cylindrical plug 1 (i.e. core) is supported for rotation. The plug has a central key channel 27 communicating with blind borings 28 extending in a transverse direction to the key channel on both sides thereof for accommodating magnetic rotary members or rotors 3. The magnetic rotors are illustrated in detail in FIGS. 9 and 10. Each magnetic rotor 3 has its base facing the housing in the form of a cone having on its surface at least one secant groove 17. This groove 17 extends off the center point 29 of the conical base so that this point 29 can be used as a pivot point for the rotary member 3. As known, the magnetic rotors include, respectively, permanent magnets which cooperate with magnets in the key in such a manner that in a predetermined angular position of the rotary members 3 the secant grooves 17 are in alignment with longitudinal grooves 15 in plug 1 (FIG. 1).

A sleeve 2 is rotatably arranged around the plug 1 and can be axially displaced about a certain distance. Sleeve 2 is coupled to plug 1 by bolts 21 projecting from plug 1 into oblong slots 20 in the sleeve so that sleeve 2 can be axially displaced relative to the plug but is connected by the bolts 21 for a joint rotation therewith. In addition, the sleeve 2 is provided with inwardly projecting arresting pins 13 which during the axial movement of sleeve 2 are guided either in the longitudinal groove 15 in plug 1 or in the secant grooves 17 in rotary members 3. The longitudinal groove 15 extends throughout the entire length of plug 1 so as to engage several pins 13. Instead of inwardly stamped arresting pins 13 there can be used other arresting elements such as, for example, arresting bolts 14 as indicated by dash lines. These bolts 14 are inserted into corresponding holes in the sleeve after the latter has been placed on the plug 1. When arresting bolts 14 are used instead of the bulged-in arresting pins 13, the longitudinal groove 15 in plug 1 can be dispensed with and replaced by milled recesses 16 (FIG. 6) and the magnetic rotors 3 can be provided with corresponding recesses 19.

Figure 11:
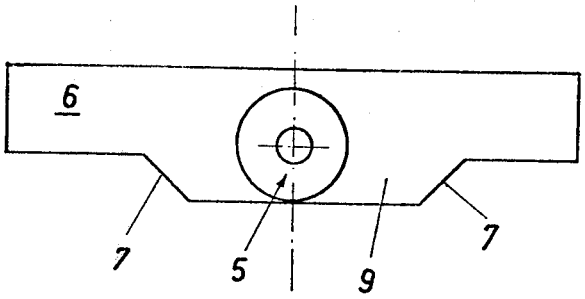
FIG. 11 is a side view of an arresting ring.
Figure 12:
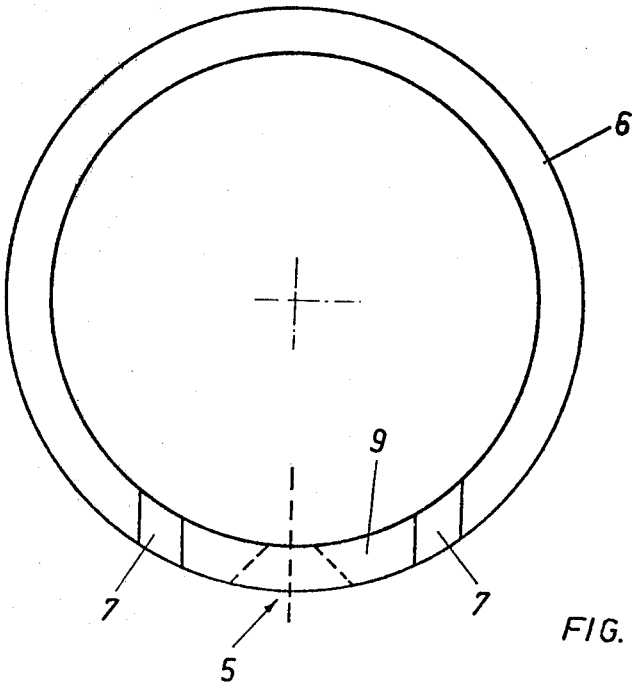
FIG. 12 is a front view of the ring of FIG. 11.

A stop ring 6 facing the sleeve 2 is arranged around the plug 1 and can be rotated relative to housing 4 and to the plug 1. The angular position of stop ring 6 relative to the housing is releasably fixed by means of a ball-and-socket catch 5. The face of the stop ring 6 opposite the sleeve 2 has an axial extension 9 with an inclined run-up surface 7 which engage corresponding run-up surfaces 8 of a sleeve recess 10 (FIGS. 1, 11 and 12).

Figure 2:
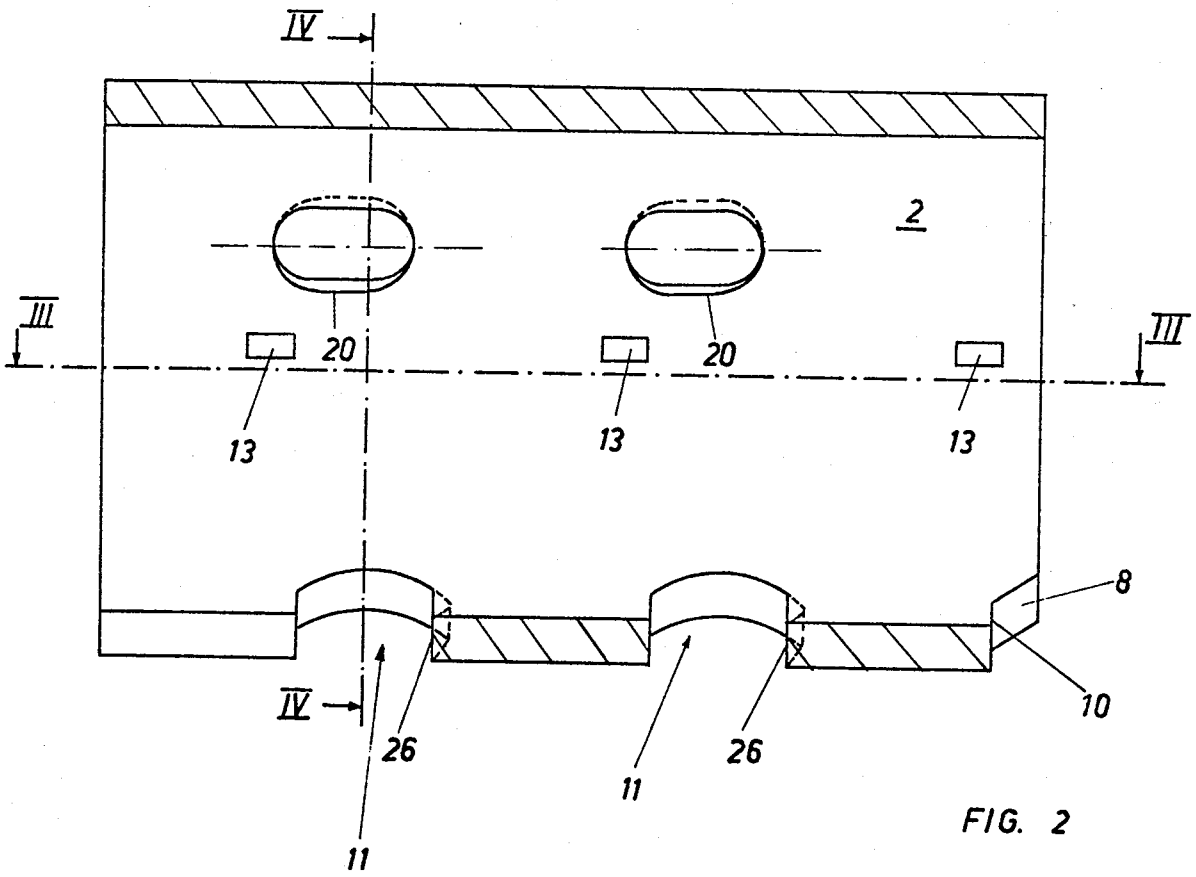
FIG. 2 is a sectional side view of the sleeve taken along the line II—II of FIG. 3.
Figure 3:
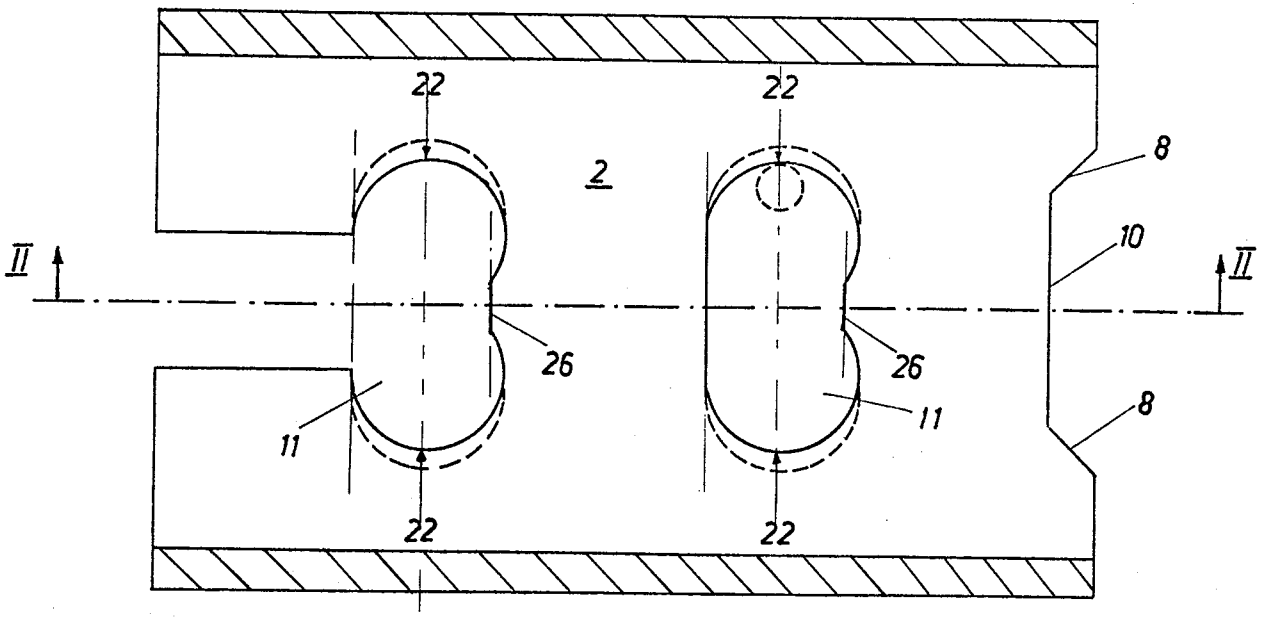
FIG. 3 is a sectional side view of the sleeve taken along the line III—III of FIG. 2.
Figure 4:
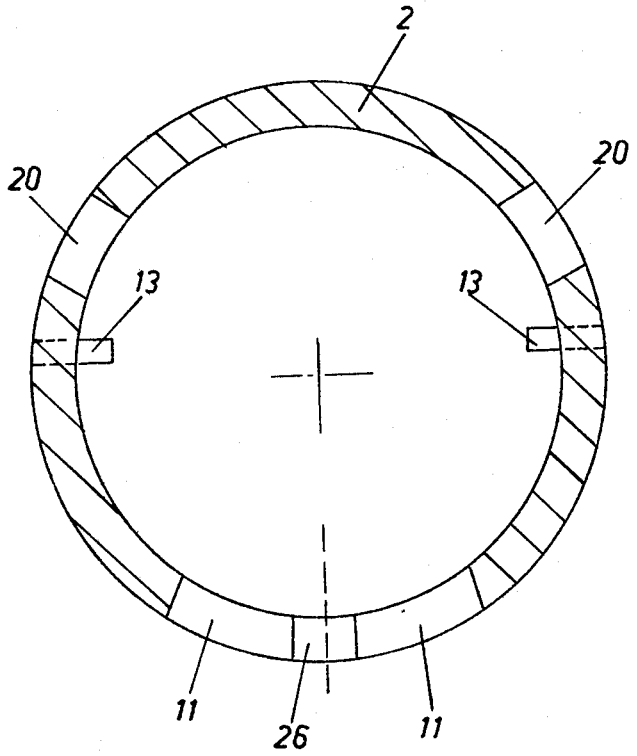
FIG. 4 is a radial section of the sleeve taken along the line IV—IV of FIG. 2.

Referring now to FIGS. 2 and 3, sleeve 2 has two arresting openings 11 cooperating with spring-biased inset pins 12 guided in aligned radial passages in housing 4. In the position as shown in FIG. 1, the inset pins 12 project through openings 11 and engage conical recesses 23 in plug 1. This arresting position of pins 12 is also indicated by dashed lines in FIG. 8. The arresting openings 11 as seen from FIG. 3 have the form of circumferentially directed oblong slots and the conical recesses 23 in the plug are assigned to each stop area 22 at respective ends of these oblong slots.

In a particular embodiment, the control device of this invention can be combined with conventional two-segment tumbler pins 24.

The operation of the control device of this invention is as follows:

If a key 30 including key magnets arranged according to a predetermined code is inserted into the key channel 27, the magnetic rotors 3 turn into the position as illustrated in FIG. 1, that means the secant grooves 17 are in alignment with longitudinal grooves 15 of plug 1. The frustoconical ends 31 of inset pins 12 bear against the cylindrical wall of plug 1 and their conical surfaces are brought into abutment with an intermediate edge portion 26 of arresting openings 11 in sleeve 2. By pressure exerted by springs 32, the pins 12 move the sleeve in axial direction inwardly (to the right in the drawing) until the axial extension 9 of stop ring 6 engages the matching recess 10 in sleeve 2.

By rotating key 30, plug 1 as well as sleeve 2 connected to the plug by the groove-and-pin connection 20 and 21 is rotated therewith and a run-up surface 8 of sleeve 2 slides on the run-up surface 7 of the stop member 6 and in doing so the sleeve 2 is displaced outwardly, (to the left in the drawing). As mentioned above, the stop ring 6 is held in its fixed position relative to the housing by the ball-and-socket catch 5. The intermediate edges 26 of arresting openings 11 are pressed against the tapering surfaces of frustoconical ends 31 of inset pins 12 and consequently the pins are pressed against the springs 32 into their passages in housing 4. At the same time the arresting pins 13 enter the secant grooves 17 in rotary members 3. In the unblocked position, plug 1 can be rotated about 360° and during this rotation, coupling parts 25 of an arresting ring 33 are actuated. Upon the turning of the plug about 360°, the inset pins 12 reenter the arresting openings 11 in sleeve 2 and the tapering surfaces of their end portions 31 urge the sleeve to the right to resume its initial starting position in contact with the stop ring 6.

If a wrong key is inserted into the key channel 27, the magnetic rotary members 3 take a non-aligned angular position in which their secant grooves 17 are not aligned with the longitudinal grooves 15 in the plug. By rotating the plug, the arresting pins 13 abut, therefore, against the cylindrical wall 34 of the non-aligned rotary members 3 and axial movement of sleeve 2 is prevented. On further turning of the key 30, the stop ring 6 is taken up by the sleeve recess 10 and rotated against the spring-biased ball catch 5. In this blocking axial position of sleeve 2, the tapering end surfaces 31 of inset pins 12 do not act against the intermediate edge 26 of arresting opening 11, but bear against a stop point 22 at the end of the opening 11 and snap into the fitting conical recesses 23 in plug 1 as indicated by dash lines in FIGS. 3 and 8. As a result, rotary forces applied by key 30 are not intercepted by the sensitive magnetic rotors 3 but by the strong inset pins 12.

Figure 13:
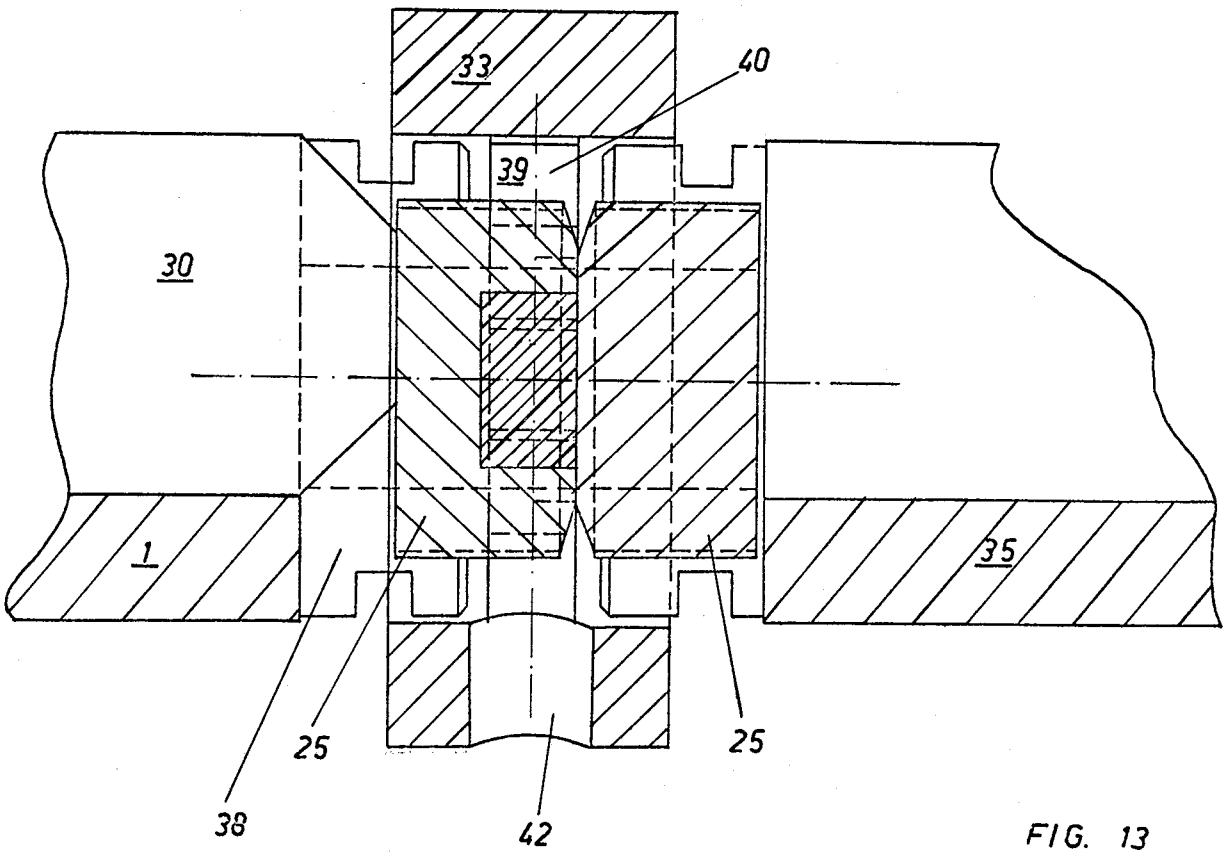
FIG. 13 is a cut-away axial view, partly in section of coupling means in a double-cylinder lock.
Figure 14:
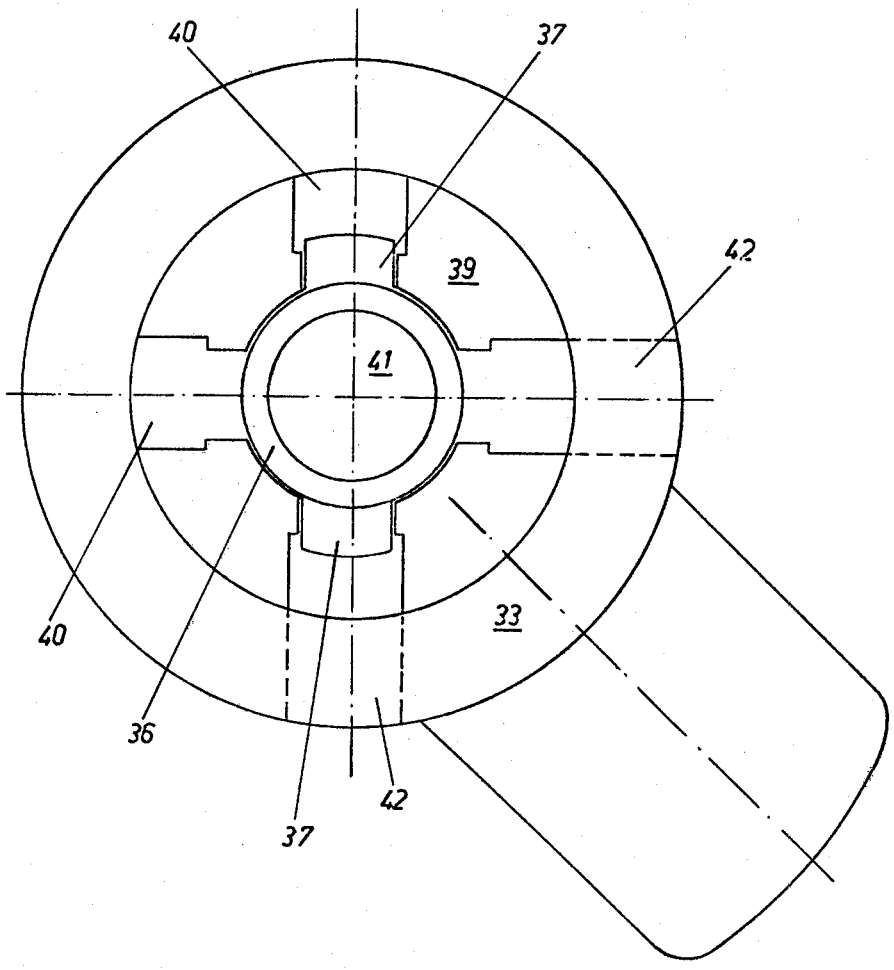
FIG. 14 is a front view of the coupling means of FIG. 13.

In the preferred embodiments of the device of this invention, a two-piece coupling 25 is provided in the range of arresting ring 33 between two segments 1 and 35 of the plug (FIGS. 13 and 14). The coupling parts 25 have the same shape and each is formed of a cylindrical body 36 having two opposite wing-shaped attachments 37. Coupling parts 25 are supported for axial displacement in correspondingly shaped axial grooves 38 in respective segments 1 and 35 of the plug. The arresting ring 33 has a central plate 39 provided with crossing slits 40 which are shaped for lockingly engaging coupling parts 25 either from the right or from the left. In the embodiment as illustrated in FIG. 13, the left-hand coupling part 25 includes on its face a coupling magnet 41 which magnetically attracts the other coupling part 25. In a modification, both coupling parts 25 can be provided with oppositely poled coupling magnets or one or both coupling members can be made of a magnetic material such as barium ferrite or of Al-Ni-Co alloy.

Upon a complete insertion of a key 30 into key channel 27, both coupling parts 25 are displaced in axial direction so that the coupling part 25 adjoining the key is situated between the cylindrical plug segment 1 and the arresting ring 33 while the other coupling part 25 is situated outside the range of the arresting ring. In this position the plug segment 1 together with the arresting ring 33 can be turned by key 30 without turning the other plug segment 35. As seen from FIGS. 13 and 14, both crossing slots 40 in plate 39 of ring 33 communicate, respectively, with radial borings 42 in the arresting ring 33. A nonillustrated pin passes through each boring 42 and enables the separation of the two coupling parts 25 from one another. As a result of the separation, the arresting ring 33 can be rotated relative to the cylindrical plug and the lock can be easily converted from a counterclockwise operation to a clockwise operation.

The coupling 25 according to this invention is particularly simple in construction and does not need any spring elements for achieving an exact guiding of respective coupling parts. Inasmuch as no spring elements are used, the coupling 25 can be easily inserted into a double cylinder lock after the assembly of the latter.

Figure 15:
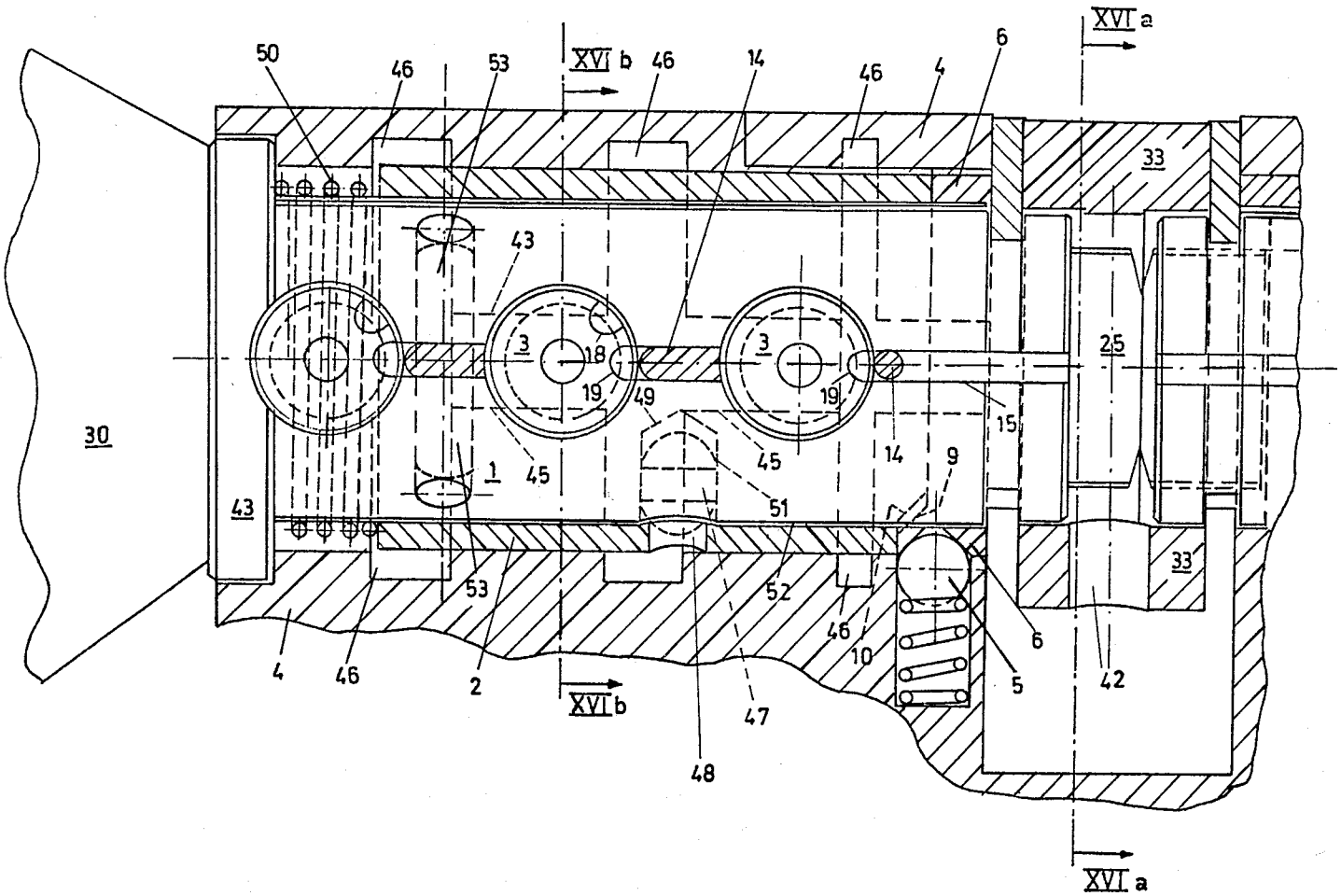
FIG. 15 is a side view partly in section of another embodiment of the control device of this invention.
Figure 16:
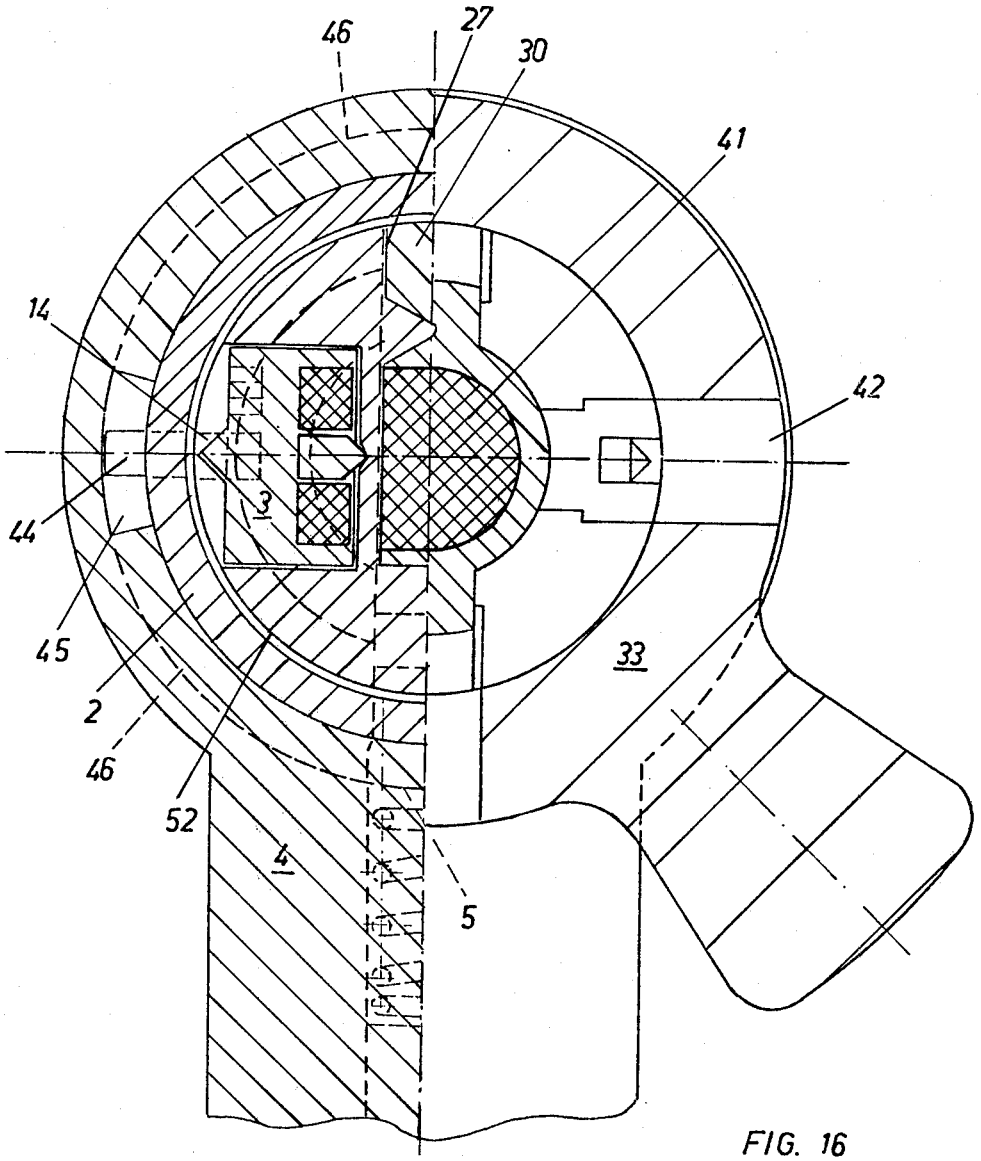
FIG. 16 is a radial section of the embodiment of FIG. 15 whereby the right-hand half is a section along the line XVIa—XVIa and the left-hand half is a section taken along the line XVIb—XVIb of FIG. 15.

In another embodiment of this invention as illustrated in FIGS. 15 and 16, arresting bolts 14 are extended outwardly by outer arresting sections 44 which project into axially directed longitudinal grooves 45 formed in the inner surface of housing 4. The grooves 45 allow axial displacement of sleeve 2. In the axially displaced position of the sleeve the axial extension 9 of stop ring 6 is out of engagement with the sleeve recess 10 and key 30 can turn plug section 1 together with sleeve 2. The inner wall of housing 4 opposite the arresting sections 44 is provided with annular groove 46. In order to place sleeve 2 into its starting position after its turning about 360°, a sleeve spring 50 is disposed between a collar 43 at the inlet opening of housing 4 and the face of the sleeve 2. Reference numeral 52 indicates a thin jacket surrounding plug 1 to seal the latter outwardly and to facilitate the sliding movement of magnetic rotary members 3 and of sleeve 2.

Figure 5:
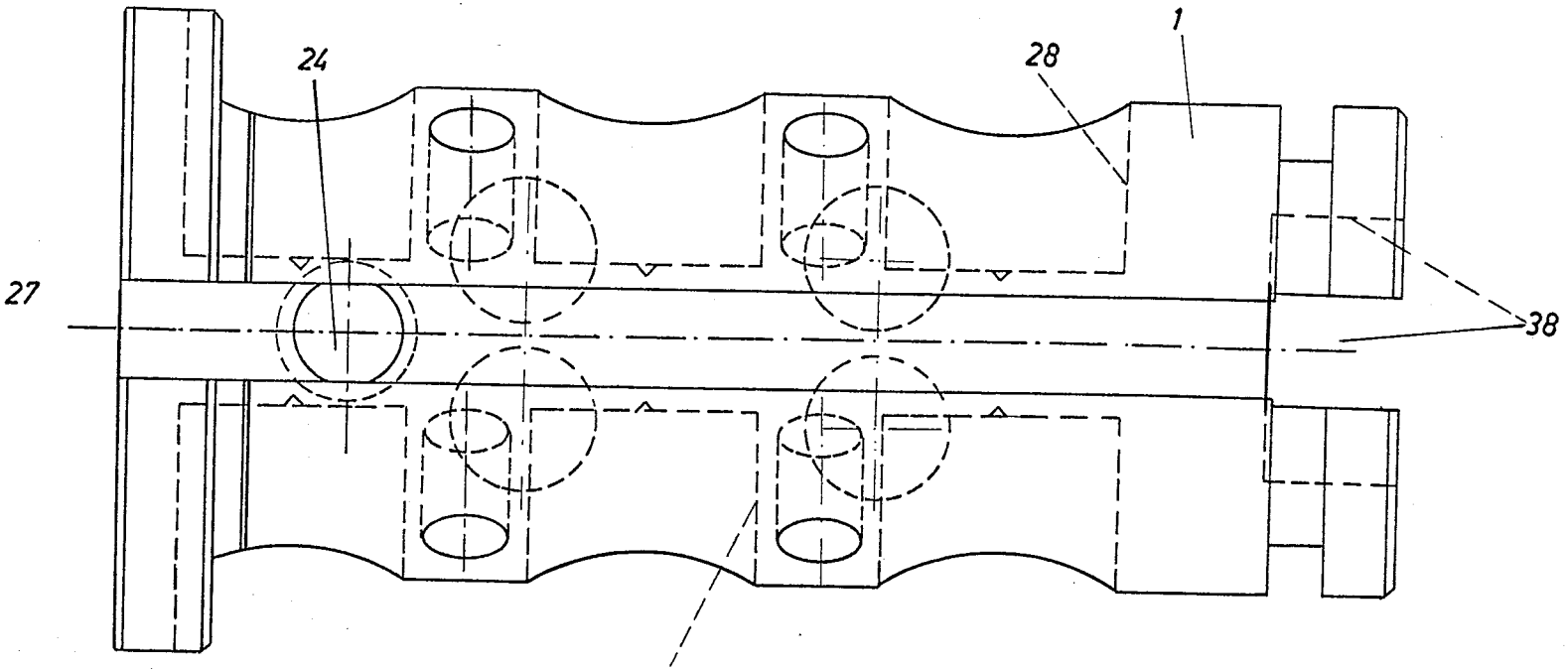
FIG. 5 is a top view of a plug of the device of FIG. 1.
Figure 6:
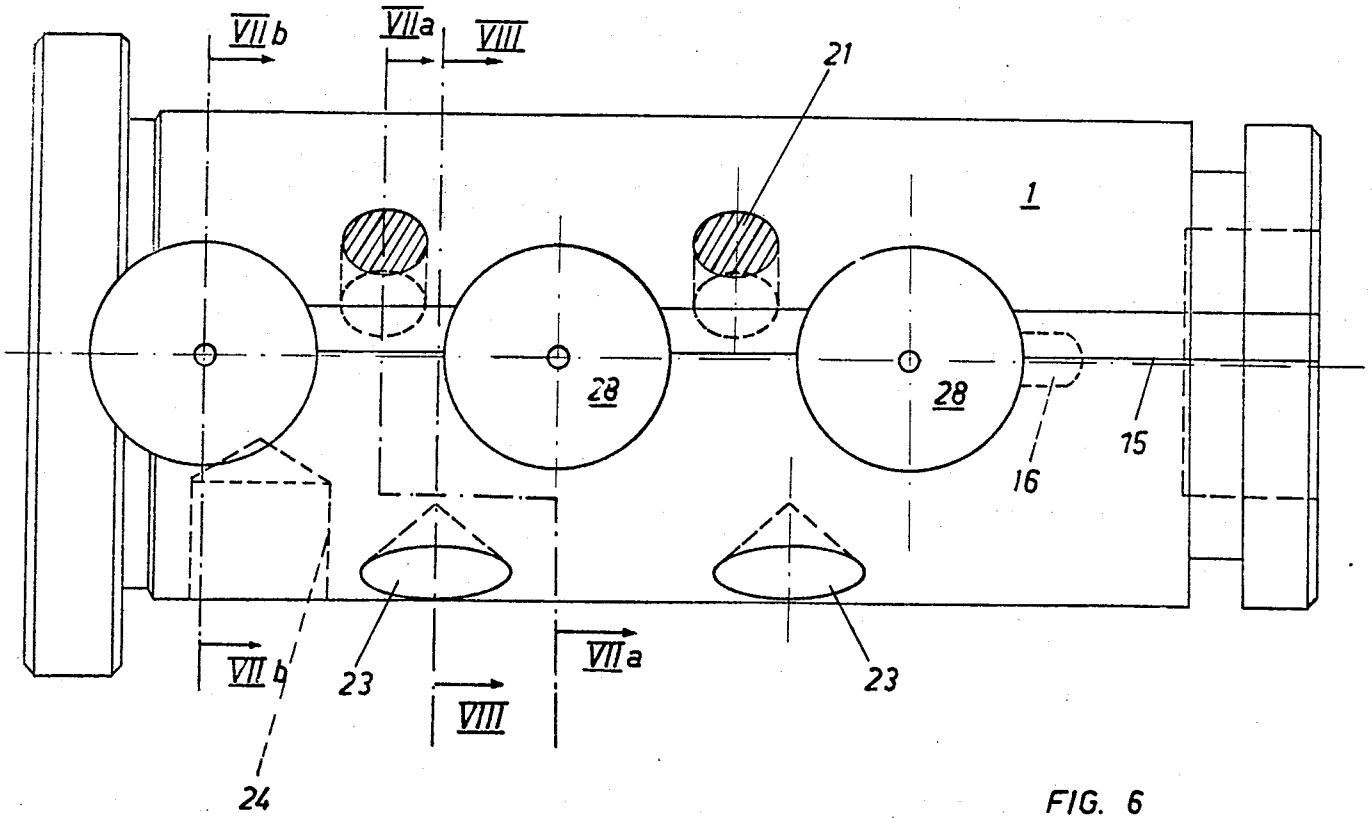
FIG. 6 is a side view of the plug of FIG. 5.
Figure 7:
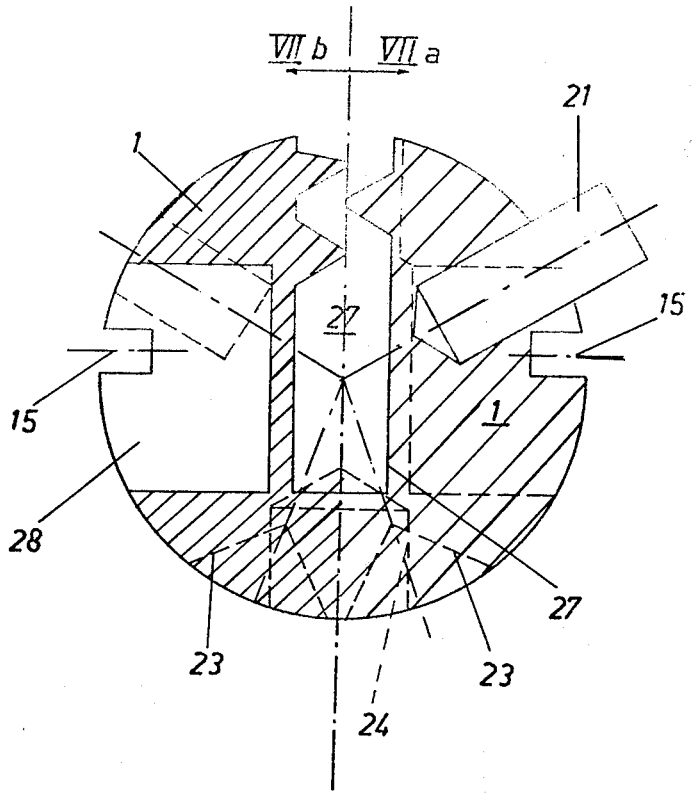
FIG. 7 is a radial section of the plug of FIG. 6 whereby the right-hand half is taken along the line VIIa—VIIa and the left-hand half is taken along the line VIIb—VIIb of FIG. 6.
Figure 8:
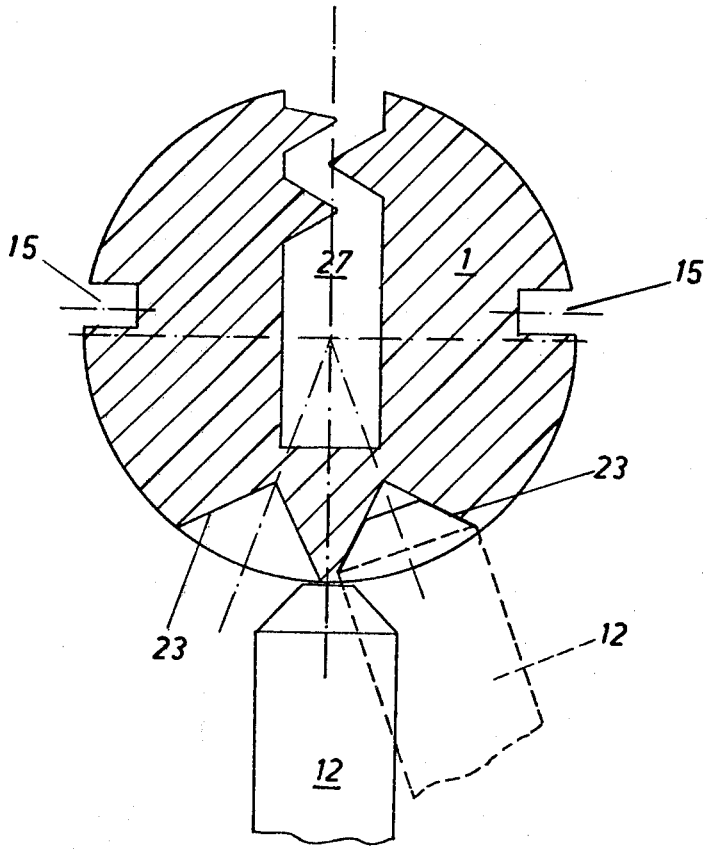
FIG. 8 is a radial section of the plug of FIG. 6 taken along the line VIII—VIII.

Instead of the tumbler pin 24 shown in FIG. 5 in the preceding embodiment, the embodiment of FIGS. 15 and 16 employs a key-holding pin 47 which is slidably supported in boring 51 between sleeve 2 and key channel 27. In the rest position of the lock, one end of the key-holding pin 47 projects into an arresting boring 48 in sleeve 2 so that the other end of the pin does not project into the key channel and key 30 can easily be introduced therein. Due to the axial displacement of the sleeve resulting from the rotation of plug 1 as it has been described in detail above, the key-holding pin 47 is shifted upwardly into the key channel 27 and engages a corresponding key recess 49. In this manner, key 30 is maintained in a correct position as long as the sleeve remains in its axially shifted position.

It will be understood that each of the elements described above, or two or more together, may also find a useful application in other types of constructions differing from the types described above. For example, if this invention is applied in a simple one-cylinder lock, one coupling can be dispensed with. The number of magnetic rotors in the cylindrical plug can be chosen at will. In different lock systems, the magnetic rotors can have additional (for example light) recesses, apart from the secant groove 17 or the recess 19. To make the decoding of the magnetic code of the control device more difficult, the magnetic rotors can also be provided with phantom recesses.

The outer arresting sections 44 employed in the second embodiment of this invention need not be in alignment with arresting bolts 14 or need not be made as onepiece. Instead they may be situated at different points on the sleeve provided that their position on the latter is maintained.

In the second embodiment of this invention, the rotary forces between plug 1 and sleeve 2 are not transmitted via guiding bolts and longitudinal grooves as in the first embodiment but via the arresting bolts 14 which engage the longitudinal grooves 15 in the plug. To reinforce the borings in the plug, pins 53 of a hard metal are disposed therein. These protective pins 53, however, do not project above the cylindrical surface of the plug.

If desired, sleeve 2 can be provided with two sleeve recesses 10 which are mutually staggered by about 180° so that a 180 degree locking operation is made possible. The embodiment according to FIG. 1 may be preferred for reason of greater strength in the case when each cylindrical plug section has more than six magnetic rotors, for example up to sixteen rotors. Locks of this type are used with advantage in a master locking system since a sufficiently large number of code combinations or variations is made possible. In the second embodiment of this invention according to FIGS. 15 and 16, it is also advantageous when two segment tumber pins 47 are used because in this case, the sleeve spring 50 can be dispensed with and the axial return of the sleeve is accomplished by means of inset pins in the housing similar to inset pins 12 shown in FIG. 1. Also in the construction according to FIGS. 15 and 16, it can be advantageous to employ these inset pins 12 for controlling the movement of sleeve 2.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A control device, particularly for use in connection with a lock, comprising a tubular housing eventually having in its inner wall a first arresting recess; a plug disposed for rotation in said housing and having on its outer surface a second arresting recess; at least one magnetic rotary member arranged in said plug for rotation about an axis transverse to the center axis of the plug and defining on its surface a third arresting recess alignable with said second arresting recess; a sleeve arranged for rotation and for an axial displacement between said housing and said plug; and arresting elements connected to said sleeve and arranged for selectively engaging said recesses.

2. The device as defined in claim 1, further including a stop ring arranged for rotation in said housing opposite a face of said sleeve and having an inwardly projecting axial extension with lateral run-up surfaces, said sleeve defining recessed surfaces cooperating with said run-up surfaces of said axial extension.

3. The device as defined in claim 1, further including a spring-biased ball-socket catch arranged between said housing and said stop ring to releasably hold the latter in a fixed angular position relative to the housing.

4. The device as defined in claim 2, further including means for coupling said sleeve to said plug for a joint rotation and for permitting an axial displacement of said sleeve, said run-up surfaces in said axial extension of said stop ring being formed on lateral shoulders of said extension to engage the recessed surfaces of said sleeve recess during the rotation of said plug and to displace the sleeve in axial direction.

5. The device as defined in claim 4, wherein said second recess in said plug includes a longitudinal groove extending in axial direction in the outer surface of said plug, said arresting elements being in the form of inwardly projecting pins or bolts engaging said longitudinal groove, and cooperating with said third recesses in said magnetic rotary members to permit and, alternatively, to prevent the axial displacement of the sleeve in response to the angular position of said magnetic rotary members.

6. The device as defined in claim 4, wherein said means for coupling said sleeve to said plug include axially directed slot in said sleeve and coupling pins projecting from said plug into said slot.

7. The device as defined in claim 6, wherein said first recess in the inner wall of said housing includes axial and circumferential grooves, said arresting elements projecting from said sleeve into said grooves, said circumferential grooves communicating with said axial grooves at a point facing said arresting elements at the axially displaced position of said sleeve from said stop ring so as to guide said arresting elements during the rotation of said sleeve and of said plug.

8. The device as defined in claim 7, wherein said arresting elements include an inwardly projecting section for cooperation with said second recess and an outwardly projecting section for cooperating with said first recess.

9. The device as defined in claim 1, further including tumbler pins arranged in said plug.

10. The device as defined in claim 8, wherein said plug has a central key channel, said sleeve and said plug including a key-retaining pin projecting into said key channel to hold the key in a predetermined position.

11. The device as defined in claim 1, for use in connection with a double cylinder lock having two plug segments and two sleeve sections arranged in series in said housing, an arresting ring arranged between said plug segments and said sleeve sections and at least two magnetic coupling parts movably disposed in the range of said arresting ring between said plug segments to disconnectably couple the latter.

12. The device as defined in claim 11, wherein at least one coupling part is made of magnetic Al-Ni-Co magnetic material.

* * * * *